US012286862B2

(12) United States Patent
Scoggins

(10) Patent No.: US 12,286,862 B2
(45) **Date of Patent: *Apr. 29, 2025**

(54) COMPOSITE CEMENT RETAINER

(71) Applicant: Brad Scoggins, Odessa, TX (US)

(72) Inventor: Brad Scoggins, Odessa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/085,328

(22) Filed: Dec. 20, 2022

(65) Prior Publication Data

US 2023/0123688 A1 Apr. 20, 2023

Related U.S. Application Data

(63) Continuation of application No. 17/065,388, filed on Oct. 7, 2020, now Pat. No. 11,555,375.

(60) Provisional application No. 62/938,128, filed on Nov. 20, 2019, provisional application No. 62/911,940, filed on Oct. 7, 2019.

(51) Int. Cl.
*E21B 33/13* (2006.01)
*E21B 34/06* (2006.01)

(52) U.S. Cl.
CPC ..... *E21B 33/13* (2013.01); *E21B 34/06* (2013.01)

(58) Field of Classification Search
CPC ..... E21B 33/13; E21B 34/06; E21B 33/1292; E21B 33/165
See application file for complete search history.

(56) References Cited

U.S. PATENT DOCUMENTS 4,708,202 A * 11/1987 Sukup ..... E21B 33/1204 166/123
6,364,013 B1 * 4/2002 Watson ..... E21B 43/128 417/366
9,845,658 B1 * 12/2017 Nish ..... E21B 33/128
10,961,811 B2 * 3/2021 Zeng ..... E21B 33/134
2008/0073074 A1 * 3/2008 Frazier ..... E21B 33/1294 166/138
2008/0169105 A1 * 7/2008 Williamson ..... E21B 33/1294 166/374
2008/0190600 A1 * 8/2008 Shkurti ..... E21B 33/134 166/134
2012/0012343 A1 * 1/2012 Wilkin ..... E21B 33/134 166/120
2014/0166283 A1 * 6/2014 Gregory ..... E21B 33/134 166/192
2014/0166317 A1 * 6/2014 Gregory ..... E21B 33/134 166/387
2014/0174738 A1 * 6/2014 Gregory ..... E21B 33/134 166/192
2014/0190685 A1 * 7/2014 Frazier ..... E21B 43/11 166/135
2016/0123100 A1 * 5/2016 Tse ..... E21B 33/128 166/387

(Continued)

FOREIGN PATENT DOCUMENTS

CN 113187432 7/2021

*Primary Examiner* — Steven A Macdonald
(74) *Attorney, Agent, or Firm* — Braxton Perrone, PLLC; Bobby W. Braxton; Gregory Perrone

(57) ABSTRACT

A system and method for a composite cement retainer. A composite cement retainer has various components. When these various components comprise composite where feasible, or a drillable metal, the retainer can be easily placed and quickly drilled if necessary.

13 Claims, 6 Drawing Sheets

(56) References Cited

U.S. PATENT DOCUMENTS

2018/0171749 A1* 6/2018 Yue ..... E21B 33/1293
2020/0072020 A1* 3/2020 Dirocco ..... E21B 33/134

* cited by examiner

COMPOSITE CEMENT RETAINER

BACKGROUND OF THE INVENTION

Priority

This application is a continuation of U.S. Non-Provisional patent application Ser. No. 17/065,388 filed Oct. 7, 2020, which claims priority to U.S. Provisional Application No. 62/911,940 filed Oct. 7, 2019 as well as U.S. Provisional Application No. 62/938,128 filed Nov. 20, 2019, the entirety of all of which are hereby incorporated by reference.

Technical Field

The present invention relates to a system and method for a composite cement retainer.

Description of Related Art

Cement retainers are used throughout the oil and gas industry. However, many retainers fail to perform as desired. Specifically, they often take too long to get into place, take too long to drill through, and fail to properly remain in the desired location. Consequently, there is a need for an improved cement retainer.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Cement retainers have wide and various uses throughout the oil and gas industry. They can be used to deliver cement downhole and squeeze and maintain the pressure downstream of the retainer. Cement retainers are very versatile. As noted, however, sometimes a cement retainer fails to stay in the correct location. If the retainer undesirably moves after placement, the retainer must often be retrieved and replaced. In such and other situations, it may become necessary to drill through the cement retainer to retrieve it from downhole. Cement retainers comprising mostly metal can take significant time and resources to drill through. The metal can damage the drill bits, further slowing down the time to remove and increasing the cost in the removal. Consequently, in one embodiment the retainer comprises a composite material. In some embodiments the retainer comprises components which comprise drillable metals such as aluminum.

A composite material, as used herein, refers to a non-metal, plastic and/or glass based material. The material is typically lighter than the standard cast iron, and the composite material is much easier to drill through compared to a cast iron retainer.

Various composites can be utilized. In one embodiment the composite comprises an epoxy based resin systems and glass roving. The various components can comprise the same or different composite. As an example, in one embodiment the mandrel composite comprises Pactomite ER-1030 (black) epoxy based resin with equal to or greater than 70% glass fiber by weight. The nose/cone material, in one embodiment composite comprises Pactomite ER-1039 (Red) epoxy based resin with equal to or greater than 70% glass fiber by weight.

Figure 1:
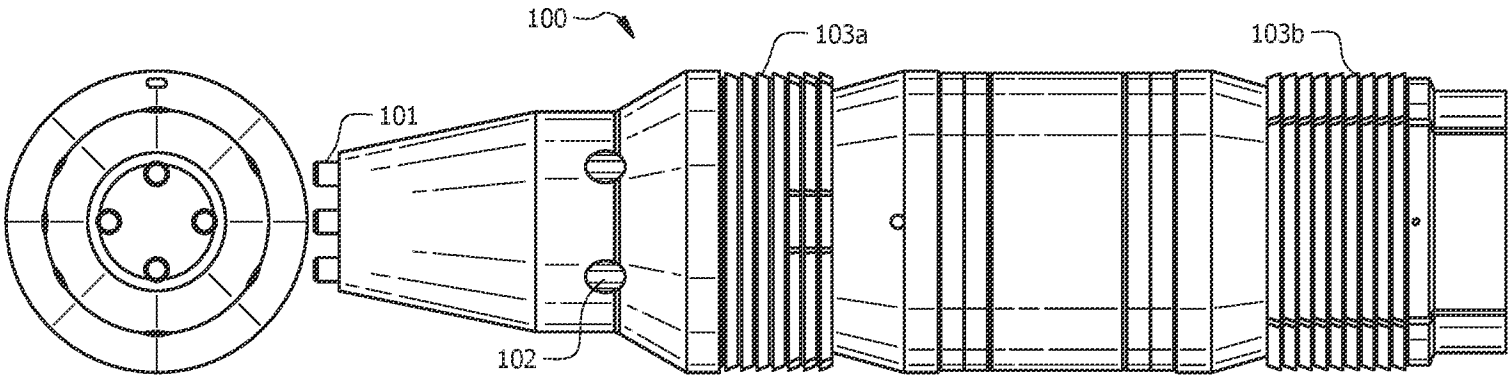
FIG. 1 is a perspective view of a cement retainer in one embodiment.

Turning to FIG. 1, FIG. 1 is a perspective view of a cement retainer in one embodiment. FIG. 1 shows one retainer 100 in one embodiment. While one embodiment depicting a specific layout of a retainer 100 is shown, this is for illustrative purposes only and should not be deemed limiting.

Figure 2:
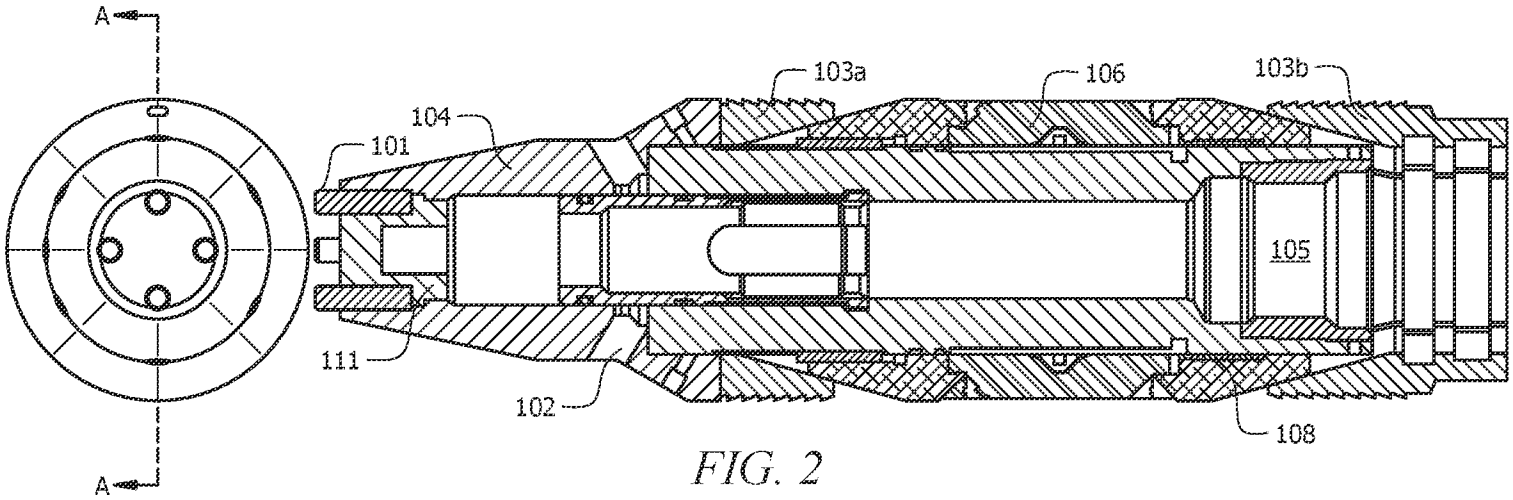
FIG. 2 is a cross-sectional view of the cement retainer in FIG. 1.
Figure 3:
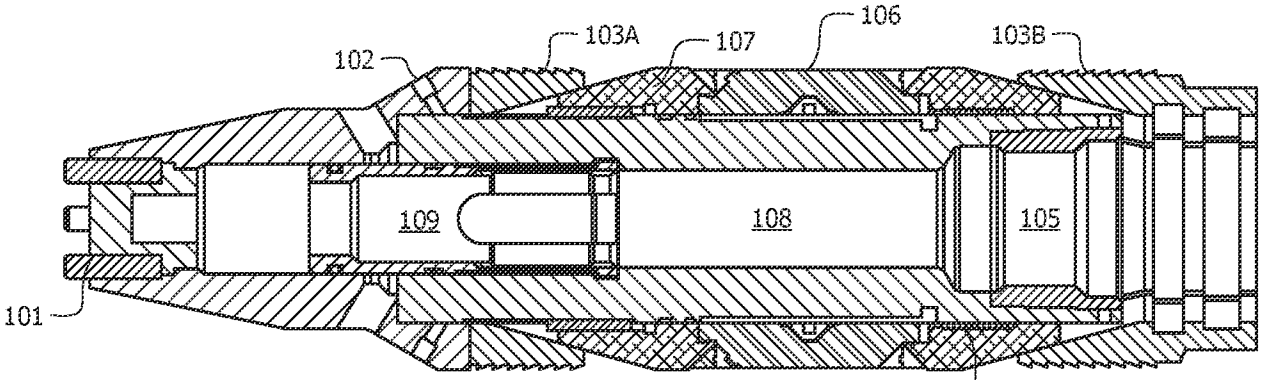
FIG. 3 is a cross-sectional schematic of the cement retainer in FIG. 1.

FIG. 2 is a cross-sectional view of the cement retainer in FIG. 1, and FIG. 3 is a cross-sectional schematic of the cement retainer in FIG. 1. The three figures, taken together, give an example of the outer casing as well as the cross-sectional views of the retainer in one embodiment.

As shown in FIG. 1 on the downstream end of the retainer 100 is the nose cone 104. As depicted, the head has a semi-conical shape as it tapers downstream. As used herein, downstream and upstream refer to relative locations on the retainer. The end which is depicted on the left in FIG. 1, is the end which goes further downhole. This is referred to as the downstream end. An element to the right of the downstream end is referred as being upstream of the downstream end.

The tapered shape of the nose cone 104 allows for increased navigation of the retainer 100 through the hole. The nose cone 104 can comprise a variety of materials. In one embodiment the nose cone 104 comprises composite as opposed to cast iron. A nose cone 104 comprising composite can be drilled through significantly faster than a prior art cast iron head. This decreased drilling time results in significant cost savings.

In one embodiment the nose cone 104 is separately manufactured and machined to include the outlet ports 102 prior to being coupled with other components. The outlet ports 102 are external holes in the surface of the nose cone 104 which allow a material, such as cement, to be pumped downstream. In one embodiment the outlet ports 102 are in fluid communication with the valving system 109, as discussed in more detail below. The size and location of the outlet ports 102 can be adjusted depending upon the desired application.

As shown, the most downstream portion of the retainer 100 are the teeth 100. The teeth 101, as depicted, are cylindrical pieces which extend outward above the downstream end of the nose cone 104. The teeth 101 can be used to remove debris and other objects which are downstream of the retainer 100 which prevent the retainer 100 from advancing further downhole.

In one embodiment the teeth 101 are composite. The composite used for the teeth 101 can be the same or different composite as used in other parts of the retainer. In one embodiment the teeth are coupled to a retaining head 111, as shown in FIG. 2, for example. In one embodiment the retaining head 111 is not made of composite, but instead comprises a metal. In one embodiment the retaining head 111 comprises aluminum. In some situations, the metallic retaining head 111 better couples the teeth 101 to the nose cone 104 compared to composite. Further, the aluminum can be drilled through.

While one embodiment has been shown utilizing teeth 101, this is for illustrative purposes only and should not be deemed limiting. In other embodiments, for example, the retainer 100 does not comprise teeth 101.

Moving upstream from the nose cone 104 are the downstream slips 103*a*. The slips 103 serve to grip and secure the inner hole diameter. The slips 103 secure the retainer 100 to the hole.

In one embodiment the slips 103 comprise a metal. In one embodiment the slips 103 comprise cast iron. The reason for this is the cast iron is sufficiently rigid to adequately hold the retainer 100 in its desired location in the hole. The cast iron, in some embodiments, offers superior traction and grip compared to embodiments wherein the slips 103 are composite.

As can be seen, there is a set of downstream slips 103*a* and a set of upstream slips 103*b*. In one embodiment, and as depicted, the downstream slips 103*a* and upstream slips 103*b* have threads or teeth which face in opposite directions. As shown, the downstream slips 103*a* face downstream and prevent downstream movement whereas the upstream slips 103*b* face upstream and prevent upstream movement. In this fashion, the packing element 106 is sandwiched between the two slips and secured in place. This results in a satisfactory seal downstream of the retainer 100.

In operation, the slips 103*a,b* are in the retracted position when the retainer 100 is advanced downhole. This is advantageous as it allows the retainer 100 to maneuver the hole without getting stuck along the hole inner wall. However, when the retainer 100 has reached the desired distance downhole, the slips 103*a,b* move to an extended position, thereby increasing the effective diameter of the retainer 100. Accordingly, in one embodiment the slip is moveable between a retracted position wherein the retainer has a first effective diameter to an extended position wherein the retainer has a second effective diameter, and wherein said second effective diameter is greater than said first effective diameter.

There are various mechanisms and devices which can cause the slips 103*a,b* to move to the retracted position. Any of the prior art devices can be utilized herein. The point is to increase the diameter at the slips 103*a,b* so that the retainer 100 can be securely lodged in the desired location. As noted, in one embodiment, the slips 103 comprise a metal such as cast iron. In one such embodiment the benefit of cast iron, namely better gripping ability, outweighs the benefits of composite. Put differently, even though composite is more drillable than cast iron, because the cast iron on the slips is located on the outer periphery of the retainer 100, the impact on drillability is minimized. The positives of increased grip and retaining ability outweigh the decreased drillability.

Upstream of the downstream grip 103*a* is the packing element inner mandrel 106 and the packing element outer 107. The packing element inner mandrel 106 expands to grip the inner diameter of the hole. In so doing, the packing element inner mandrel 106 acts as a seal. This allows the downhole pressure, downstream of the retainer 100 to be maintained. If, for example, the user was pumping at a certain pressure to maintain a desired pressure downhole, the packing element inner mandrel 106 effectively seals the hole, maintaining that desired pressure. This illustrates the importance of the slips 103 and why it is necessary that the retainer maintain the desired location. In some embodiments, as described, the retainer is used to maintain a pressure at a certain location in the hole. If the retainer undesirably moves up or down the hole, that pressure is not maintained. This is one reason that in some embodiments the slips 103 comprise cast iron.

The packing element inner mandrel 106 can be expanded to create the seal in any mechanism previously utilized. In one embodiment, depicted, the retainer 100 can be manipulated to allow the packing element inner mandrel 106 to expand and create the desired seals. In one embodiment, as the packing element outer 107 is expanded, this causes the slips 103 to expand outwardly.

In one embodiment the packing element inner mandrel 106 comprises a metal such as cast iron. In other embodiments, and as depicted, the packing element inner mandrel 106 comprises a composite. Likewise, in some embodiments the packing element outer 107 comprises a metal such as cast iron, whereas in other embodiments, the packing element outer 107 comprises a composite.

Upstream of the packing elements is the upstream slip 103*b*. Internally, located adjacent the upstream slip 103*b* is the running head 105. The running head 105 couples the retainer 100 to the string, pipe, wireline, or other device which directs and controls the retainer 100. In one embodiment the running head 105 comprises an aluminum anti-rotation control nut adapter.

In one embodiment control of the running head 105 controls the operation of the retainer 100. The running head 105 can be manipulated to adjust the valving system 109, and in some embodiments, the packing element inner mandrel 106 and/or packing element outer 107. The running head 105 can be manipulated via any method known in the art. In one embodiment the running head 105 is manipulated by applying a rotational force to the running head 105.

The running head 105 can comprise a variety of materials. In one embodiment, and as depicted, the running head 105 comprises aluminum. This material is sufficiently strong and rigid that it can couple with the upstream tool. Typically, and in one embodiment, the running head 105 is coupled via threading. In some embodiments composite threading has been found insufficiently rigid or structurally sound to properly couple two devices under the pressure and strain required. Consequently, in one embodiment aluminum is utilized.

Downstream of the running head 105 is the inner tube mandrel 108. The inner tube 108 extends longitudinally along the length of the retainer 100. The inner tube mandrel 108, in one embodiment, comprises composite. The inner tube mandrel 108 couples the valving system 109 with the running head 105 and allows the valving system 109 to be controlled via the running head 105. The diameter of the inner tube mandrel 108 will vary depending upon the size and diameter of the retainer 100.

Downstream of the inner tube mandrel 108 is the valving system 109. The valving system 109 is a system which controls the valve and determines whether the outer ports 102 are open or closed. For example, during placement the valving system 109 will generally be closed. However, upon placement, the valving system 109 will be manipulated to allow a fluid, such as cement, to be pumped through the valving system 109 and exiting through the outlet ports 102.

This will allow cement to be pumped downstream of the packing element inner mandrel 106.

The valving system 109 can comprise a variety of materials. In one embodiment the valving system 109 comprises aluminum. As stated before, aluminum provides the structural rigidity necessary for a valving system, but is not so hard as to not be drillable.

In one embodiment the various components discussed herein are separately manufactured and then assembled into the retainer 100 discussed. The components can be manufactured via virtually any manufacturing process known in the art, including but not limited to molding, cast molding, blow molding, machining, etc. The manufacturing process for each component will depend upon the material utilized for that component.

As noted, many components in the retainer comprise composite. The composite material is lighter than the traditionally used cast iron. This allows the retainer to be more easily carried and manipulated. Consequently, a retainer comprising composite is generally safer to handle and manipulate than a comparatively heavier cast iron retainer.

Additionally, a retainer comprising composite is generally more drillable than a cast iron retainer. Drilling through a composite retainer will not damage or dull expensive drill bits. Composite is less hard than cast iron, so drilling through the composite material causes far less damage on the drill bit.

The composite material can be drilled out much faster than cast iron. In drilling operations, time is the most expensive factor. Drilling rigs, tools, and personnel are costly. Therefore, reducing the time to drill through a retainer is hugely valuable. A retainer which is partially composite reduces the drill through time, saving the operator valuable time and money.

As noted, there are some components on the retainer discussed herein which are not composite. Various metals have been utilized in components where composite materials would not function satisfactorily. As an example, cast iron is still used in some embodiments for the slips 103. When hard metals, such as cast iron, has been used, this is generally in the periphery of the retainer which will not significantly adversely impact drilling through the retainer. In other components, comparatively softer metals such as aluminum are used which will not significantly adversely impact drilling through the retainer.

In one embodiment the retainer comprises composite cones; aluminum sliding valve; cast iron slips, composite anti extrusion rings; two piece aluminum body insert; aluminum body lock ring.

Figure 4:
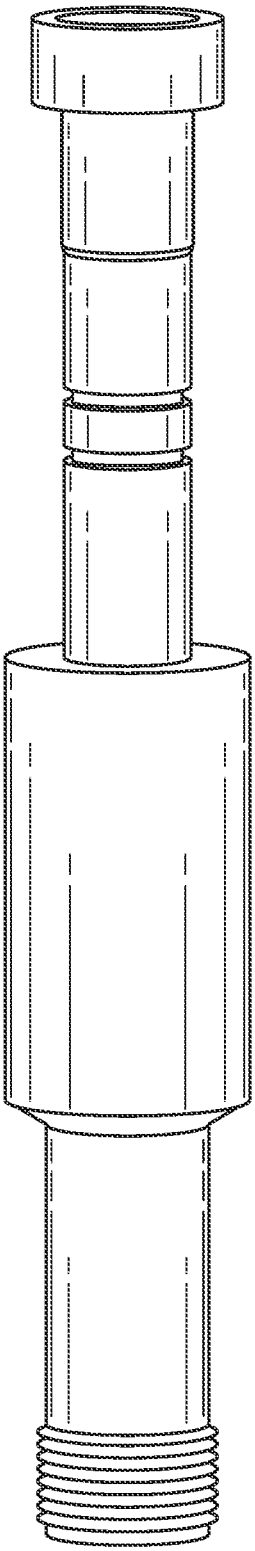
FIG. 4 is a perspective view of a cement retainer in one embodiment.
Figure 5:
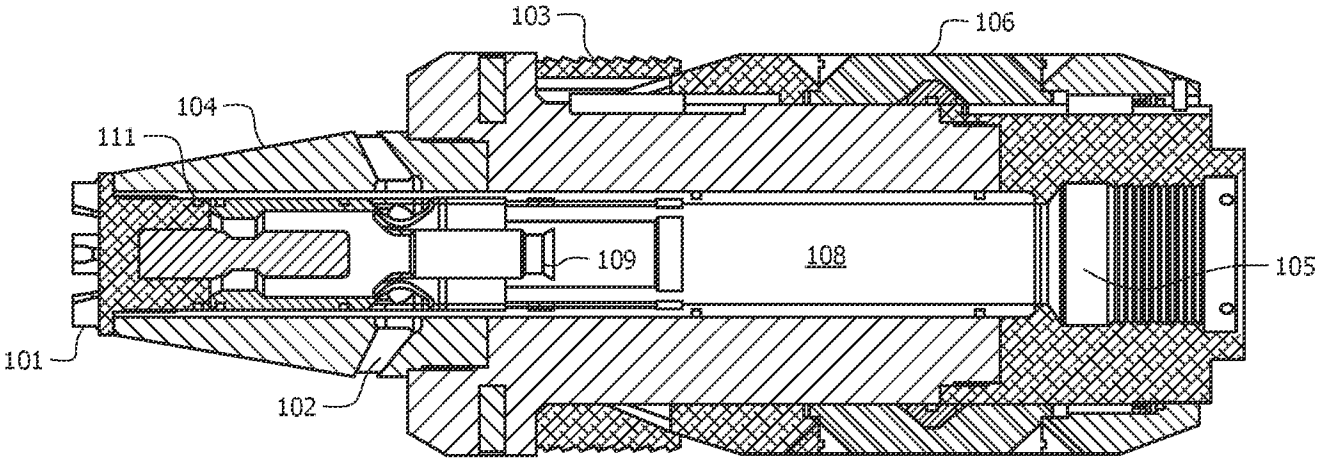
FIG. 5 is a view of an embodiment.
Figure 6:
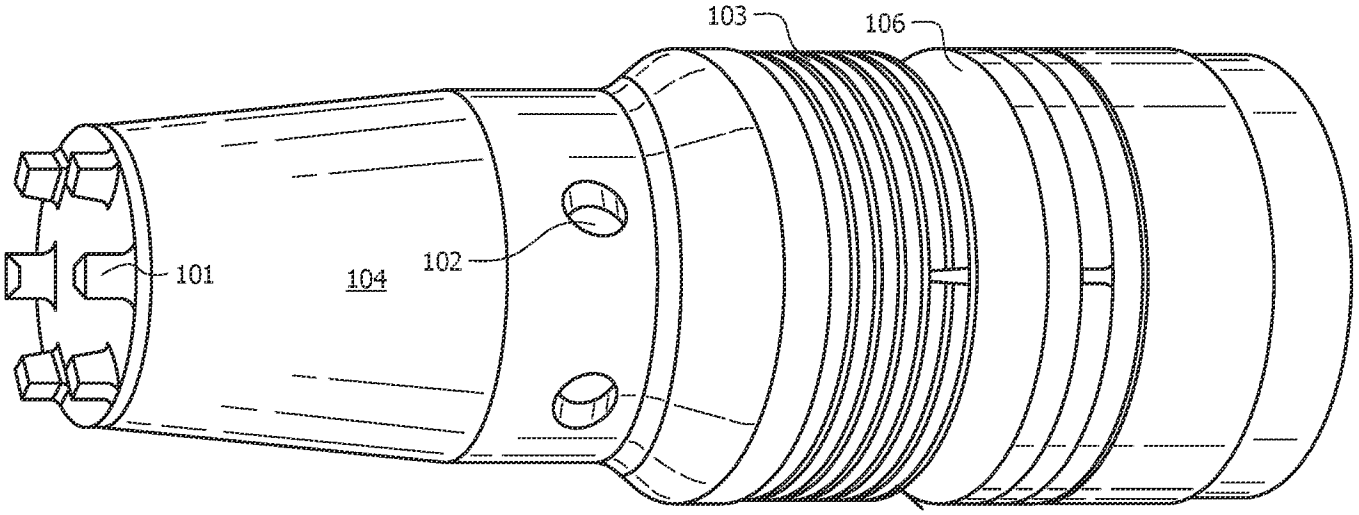
FIG. 6 is a view of an embodiment.

As noted, one embodiment has been disclosed whereby the cement retainer is loaded and set from the top. In other embodiments, however, depending upon the exact configuration, it can be beneficial to mechanically set the retainer from the bottom. In some embodiments, the bottom downhole portion of the tool, is stronger than the top end. In such embodiments the top end may be more susceptible to composite unwinding. Accordingly, if the pull force is exerted on the bottom as opposed to the top, the composite retainer is less susceptible to undesirable unravelling. FIG. 4 is a perspective view of a cement retainer in one embodiment. In such an embodiment the tool can be connected on its down hole side to achieve the benefits discussed herein. As noted, whether to attach to the top of the tool, or the bottom of the tool, will be dependent upon the geometry, layout, and material selection of the tool.

While the invention has been particularly shown and described with reference to a preferred embodiment, it will be understood by those skilled in the art that various changes in form and detail may be made therein without departing from the spirit and scope of the invention.

What is claimed is:

1. A retainer comprising:

a composite body;

a metallic running head;

metallic slips coupled to said composite body;

wherein said retainer has an upstream end and a downstream end;

a nose cone located on a downstream end of said retainer, wherein the nose cone comprises outlet ports, wherein upstream from said nose cone is at least one downstream slip, wherein said running head couples said retainer to an upstream device which controls and directs said retainer;

an inner tube mandrel coupled to and located downstream from said running head, wherein said nose cone comprises composite, wherein said running head comprises aluminum, and wherein said inner tube mandrel comprises composite.

2. The retainer of claim 1 further comprising a retaining head coupled to said nose cone, wherein said retaining head is coupled to at least two teeth.

3. The retainer of claim 1 wherein upstream from said nose cone is at least one downstream slip.

4. The retainer of claim 3 wherein said slips comprise metal, and wherein said slips do not comprise composite.

5. The retainer of claim 3 wherein there are two pairs of downstream slips, wherein each of said pair of downstream slips comprise teeth which face in opposite directions.

6. The retainer of claim 3 wherein said slip is moveable between a retracted position wherein the retainer has a first effective diameter to an extended position wherein the retainer has a second effective diameter, and wherein said second effective diameter is greater than said first effective diameter.

7. The retainer of claim 3 further comprising a packing element inner mandrel, wherein said packing element inner mandrel is expandable.

8. The retainer of claim 7 wherein said packing element inner mandrel comprises a metal.

9. The retainer of claim 3 wherein said running head is configured to couple said retainer to an upstream device which controls and directs said retainer.

10. The retainer of claim 9 further comprising a valving system downstream from said running head, and wherein said running head controls said valving system.

11. The retainer of claim 1 wherein said inner tube mandrels couples said valving system with said running head, and wherein said valving system determines whether said outlet ports are opened or closed.

12. The retainer of claim 1 comprising a cement retainer.

13. The retainer of claim 1 which is drillable.

* * * * *